US008318394B2

(12) United States Patent
Wu

(10) Patent No.: US 8,318,394 B2
(45) Date of Patent: Nov. 27, 2012

(54) SULFONAMIDE CONTAINING PHOTOCONDUCTORS

(75) Inventor: Jin Wu, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 513 days.

(21) Appl. No.: 12/644,112

(22) Filed: Dec. 22, 2009

(65) Prior Publication Data

US 2011/0151366 A1 Jun. 23, 2011

(51) Int. Cl.
*G03G 5/047* (2006.01)

(52) U.S. Cl. ..... 430/57.1; 430/58.05; 430/58.65

(58) Field of Classification Search ..... 430/57.1, 430/58.05, 58.65
See application file for complete search history.

(56) References Cited

U.S. PATENT DOCUMENTS

| | | | | |
|---|---|---|---|---|
| 4,265,990 | A | 5/1981 | Stolka et al. | |
| 4,921,769 | A | 5/1990 | Yuh et al. | |
| 5,521,306 | A | 5/1996 | Burt et al. | |
| 6,376,141 | B1 * | 4/2002 | Mishra et al. | 430/57.3 |
| 6,913,863 | B2 | 7/2005 | Wu et al. | |
| 7,037,631 | B2 | 5/2006 | Wu et al. | |
| 2002/0037189 | A1 * | 3/2002 | Kosuge | 399/350 |
| 2003/0035660 | A1 * | 2/2003 | Sugino et al. | 399/111 |
| 2003/0185599 | A1 * | 10/2003 | Enoki et al. | 399/267 |
| 2004/0048177 | A1 * | 3/2004 | Tamoto et al. | 430/58.2 |
| 2006/0105254 | A1 | 5/2006 | Wu et al. | |
| 2007/0141488 | A1 * | 6/2007 | Yu | 430/58.6 |

OTHER PUBLICATIONS

Jin Wu et al., U.S. Appl. No. 12/644,071 on Polyalkylene Glycol Benzoate Containing Photoconductors, filed concurrently herewith.
Jin Wu et al., U.S. Appl. No. 12/550,498 on Plasticizer Containing Photoconductors, filed Aug. 31, 2009.
Robert C.U. Yu et al., U.S. Appl. No. 12/471,311 on Flexible Imaging Members Having a Plasticized Imaging Layer, filed May 22, 2009.
Robert C.U. Yu et al., U.S. Appl. No. 12/434,572 on Flexible Imaging Members Without Anticurl Layer, filed May 1, 2009.
Robert C.U. Yu et al., U.S. Appl. No. 12/551,414 on Flexible Imaging Member Belts, filed Aug. 31, 2009.
Robert C.U. Yu et al., U.S. Appl. No. 12/551,440 on Flexible Imaging Member Belts, filed Aug. 31, 2009.

* cited by examiner

*Primary Examiner* — Hoa V Le
(74) *Attorney, Agent, or Firm* — Eugene O. Palazzo

(57) ABSTRACT

A photoconductor that includes a supporting substrate, an optional ground plane layer, an optional hole blocking layer, an optional adhesive layer, a photogenerating layer, and at least one charge transport layer, and where the charge transport layer or layers contains a sulfonamide.

24 Claims, No Drawings

SULFONAMIDE CONTAINING PHOTOCONDUCTORS

CROSS REFERENCE TO RELATED APPLICATIONS

Illustrated in copending U.S. application Ser. No. 12/644,071 filed concurrently herewith, is a photoconductor comprising a substrate, a photogenerating layer, and a charge transport layer, and wherein the charge transport layer contains a polyalkylene glycol benzoate.

U.S. application Ser. No. 12/550,498 filed Aug. 31, 2009 illustrates a photoconductor comprising a substrate, a photogenerating layer, and a charge transport layer, and wherein the charge transport layer contains a cyclohexanedicarboxylate, such as diisononyl cyclohexanedicarboxylate.

U.S. application Ser. No. 12/471,311, filed May 22, 2009 illustrates a flexible imaging member comprising a flexible substrate; a charge generating layer deposited on the substrate; and at least one charge transport layer deposited on the charge generating layer, wherein the charge transport layer comprises a polycarbonate, N,N'-diphenyl-N,N'-di(3-methylphenyl)-1,1-biphenyl-4,4'-diamine, a first plasticizer or a second plasticizer, and further wherein the first plasticizer and the second plasticizer are miscible with both the polycarbonate and N,N'-diphenyl-N,N'-di(3-methylphenyl)-1,1-biphenyl-4,4'-diamine.

U.S. application Ser. No. 12/434,572, filed May 1, 2009 illustrates a imaging member comprising a substrate; a charge generating layer deposited on the substrate; and at least one charge transport layer deposited on the charge generating layer, wherein the charge transport layer comprises a polycarbonate, a charge transport compound of N,N'-diphenyl-N,N'-bis(3-methylphenyl)-1,1-biphenyl-4,4'-diamine, and a liquid compound having a high boiling point, and further wherein the liquid compound is miscible with both the polycarbonate and N,N'-diphenyl-N,N'-bis(3-methylphenyl)-1,1-biphenyl-4,4'-diamine.

Examples of plasticizers illustrated in the above appropriate copending applications are, for example, dioctyl phthalate, diallyl phthalate, liquid styrene dimer, and others as illustrated by the structure formulas disclosed.

Illustrated in copending U.S. application Ser. No. 12/551,414 filed Aug. 31, 2009, is a flexible imaging member comprising a flexible substrate; a charge generating layer disposed on the charge generating layer, wherein the charge transport layer is formed from a binary solid solution comprises a charge transport component and a polycarbonate binder plasticized with a plasticizer mixture consisting of a phthalate plasticizing liquid and a plasticizer compound and further wherein the flexible imaging member does not include an anticurl back coating layer.

Illustrated in copending U.S. application Ser. No. 12/551,440 filed Aug. 31, 2009, is a layered photoconductor that includes a charge transport layer generated with a polycarbonate plasticized with a number of materials of Formulas (I) to (VII) and Formulas (1) to (5).

Titanyl phthalocyanine that can be selected as photogenerating pigments are illustrated in copending U.S. application Ser. No. 10/992,500, U.S. Publication No. 20060105254, the disclosure of which are totally incorporated herein by reference, which, for example, discloses a process for the preparation of a Type V titanyl phthalocyanine, comprising providing a Type I titanyl phthalocyanine; dissolving the Type I titanyl phthalocyanine in a solution comprising a trihaloacetic acid and an alkylene halide like methylene chloride; adding the resulting mixture comprising the dissolved Type I titanyl phthalocyanine to a solution comprising an alcohol and an alkylene halide thereby precipitating a Type Y titanyl phthalocyanine; and treating the Type Y titanyl phthalocyanine with monochlorobenzene to yield a Type V titanyl phthalocyanine.

A number of the components of the above cross referenced applications, such as the supporting substrates, resin binders, antioxidants, charge transport components, titanyl phthalocyanines, high photosensitivity titanyl phthalocyanines, such as Type V, hydroxygallium phthalocyanines, adhesive layers, and the like, may be selected for the photoconductors and imaging members of the present disclosure in embodiments thereof.

BACKGROUND

This disclosure is generally directed to layered imaging members, photoreceptors, photoconductors, and the like that can be selected for a number of systems, such as copiers and printers, especially xerographic copiers and printers. More specifically, the present disclosure is directed to multilayered drum, or flexible, belt imaging members or devices comprised of a supporting medium like a substrate; an optional ground plane layer, an optional hole blocking layer, a photogenerating layer, and a sulfonamide containing charge transport layer, including at least one or a plurality of charge transport layers.

The photoconductors disclosed herein possess a number of advantages, such as, in embodiments, the avoidance of an anticurl backing coating layer (ACBC layer) is minimal wearing of the charge transport layer or layers that, in embodiments, permits a photoconductor life of 1.4 million xerographic imaging cycles, and where there is imparted a flatness, such as for example from 150 to 180 degrees flat, orientation to the photoconductor. In addition, it is believed that further advantages of the photoconductors disclosed herein may enable the minimization or substantial elimination of undesirable ghosting on developed images, such as xerographic images, including decreased ghosting at various relative humidities; excellent cyclic and stable electrical properties; minimal charge deficient spots (CDS); compatibility with the photogenerating and charge transport resin binders; and acceptable lateral charge migration (LCM) characteristics, such as for example, excellent LCM resistance.

Ghosting refers, for example, to when a photoconductor is selectively exposed to positive charges in a number of xerographic print engines, and where some of the positive charges enter the photoconductor and manifest themselves as a latent image in the subsequent printing cycles. This print defect can cause a change in the lightness of the half tones, and is commonly referred to as a "ghost" that is generated in the previous printing cycle. An example of a source of the positive charges is the stream of positive ions emitted from the transfer corotron. Since the paper sheets are situated between the transfer corotron and the photoconductor, the photoconductor is shielded from the positive ions from the paper sheets. In the areas between the paper sheets, the photoconductor is fully exposed, thus in this paper free zone the positive charges may enter the photoconductor. As a result, these charges cause a print defect or ghost in a half tone print if one, for example, switches to a larger paper format that covers the previous paper print free zone.

Excellent cyclic stability of the photoconductor refers, for example, to almost no or minimal change in a generated known photoinduced discharge curve (PIDC), especially no or minimal residual potential cycle up after a number of charge/discharge cycles of the photoconductor, for example about 100 kilocycles, and xerographic prints of, for example, from about 80 to about 100 kiloprints. Excellent color print stability refers, for example, to substantially no or minimal change in solid area density, especially in 60 percent halftone prints, and no or minimal random color variability from print to print after a number of xerographic prints, for example 50 kiloprints.

Also included within the scope of the present disclosure are methods of imaging and printing with the photoconductors illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the toner image to a suitable image receiving substrate, and permanently affixing the image thereto. In those environments wherein the photoconductor is to be used in a printing mode, the imaging method involves the same operation with the exception that exposure can be accomplished with a laser device or image bar. More specifically, the flexible photoconductor belts disclosed herein can be selected for the Xerox Corporation iGEN® machines that generate with some versions over 100 copies per minute. Processes of imaging, especially xerographic imaging and printing, including digital and/or color printing, are thus encompassed by the present disclosure. The imaging members are, in embodiments, sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high-speed color copying and printing processes.

REFERENCES

There is illustrated in U.S. Pat. No. 7,037,631 a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

There is illustrated in U.S. Pat. No. 6,913,863 a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No. 4,265,990, wherein there is illustrated an imaging member comprised of a photogenerating layer, and a hole transport layer.

In U.S. Pat. No. 4,921,769, there are illustrated photoconductive imaging members with blocking layers of certain polyurethanes.

Illustrated in U.S. Pat. No. 5,521,306 is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811 is a process for the preparation of hydroxygallium phthalocyanine photogenerating pigments which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water, concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064 there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, hydrolyzing said pigment precursor chlorogallium phthalocyanine Type I by standard methods, for example acid pasting, subsequently treating the resulting hydrolyzed pigment hydroxygallium phthalocyanine Type I with a solvent, such as N,N-dimethylformamide, present in an amount of from about 1 to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 to 5 millimeters in diameter, at room temperature, about 25° C., for a period of from about 12 hours to about 1 week, and preferably about 24 hours.

The appropriate components, such as the supporting substrates, the photogenerating layer components, adhesive layer and hole blocking layer materials, the charge transport layer components, the overcoating layer components, and the like, of the above-recited patents may be selected for the photoconductors of the present disclosure in embodiments thereof.

EMBODIMENTS

Aspects of the present disclosure relate to a photoconductor comprising a substrate, a photogenerating layer, and a charge transport layer, and wherein the charge transport layer contains a sulfonamide; a photoconductor comprising a substrate, an optional undercoat layer thereover, an optional adhesive layer, a photogenerating layer, and at least one charge transport layer, and wherein the at least one charge transport layer in contact with the photogenerating layer contains a sulfonamide present in an amount of, for example, from about 0.01 to about 25 weight percent; a photoconductor comprised in sequence of a photogenerating layer comprised of a photogenerating pigment, and a charge transport layer, and wherein the transport layer is comprised of a charge transport component and a N-alkylbenzenesulfonamide, such as N-butylbenzenesulfonamide (obtainable as UNIPLEX® 214 from Unitex Chemical Corporation); a photoconductor comprising a supporting substrate, an optional ground plane layer, a hole blocking layer, a photogenerating layer comprised of at least one photogenerating pigment, and at least one charge transport layer comprised of at least one charge transport component, and where the charge transport layer has incorporated therein a sulfonamide; a flexible photoconductive member comprised in sequence of a supporting substrate, a ground plane layer, a hole blocking or undercoat layer, an adhesive layer, a photogenerating layer thereover comprised of at least one photogenerating pigment, and a N-butylbenzenesulfonamide (obtainable as UNIPLEX® 214 from Unitex Chemical Corporation) containing charge transport layer; a photoconductor which includes a hole blocking layer and an adhesive layer where the adhesive layer is situated between the hole blocking layer and the photogenerating layer, and the hole blocking layer is situated between the supporting substrate layer, and the adhesive layer; a photoconductor comprising a supporting substrate, a hole blocking layer, a photogenerating layer, and at least one charge transport layer comprised of at least one charge transport component, and wherein a first pass charge transport layer in contact with the photogenerating layer, and a second pass charge transport layer in contact with the first charge transport layer, and the first and second pass charge transport layers include therein a hole transport component, a resin binder, and a sulfonamide such as N-butylbenzenesulfonamide (available as UNIPLEX® 214 from Unitex Chemical Corporation); a photoconductor comprising a supporting substrate, a photogenerating layer in contact with the supporting substrate, and at least one charge transport layer in contact with the photogenerating layer, and wherein at least one, such as 1, 2, or 3 charge transport layers contains a sulfonamide as, for example, illustrated herein; a photoconductor comprised in sequence of a photogenerating layer comprised of a photogenerating pigment, such as a hydroxygallium phthalocyanine or a titanyl phthalocyanine, a first charge transport layer, and a second charge transport layer, and wherein the first and/or second charge transport layer is comprised of a charge transport component and a sulfonamide as represented by or encompassed by

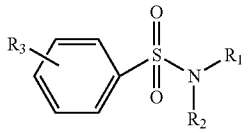

wherein $R_1$, $R_2$ and $R_3$ each independently represents hydrogen, an alkyl or substituted alkyl having, for example, from about 1 to about 18, carbon atoms, 1 to about 12 carbon atoms, 1 to about 10 carbon atoms, 1 to about 6 carbon atoms, or from about 2 to about 8 carbon atoms.

Examples of sulfonamides selected for the photoconductors illustrated herein include N-butylbenzenesulfonamide (UNIPLEX® 214 available from Unitex Chemical Corp.), o,p-toluenesulfonamide (UNIPLEX® 171 available from Unitex Chemical Corp.), N-(2-hydroxylpropyl)benzenesulfonamide (UNIPLEX® 225 available from Unitex Chemical Corp.). In embodiments, the sulfonamide selected for the charge transport layer are represented by

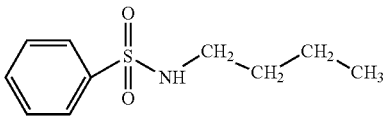

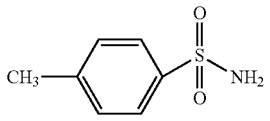

-continued

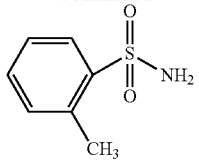

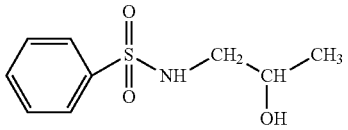

and the like, and mixtures thereof.

The sulfonamide is present in the charge transport layer in various effective amounts, such as for example, from about 0.01 to about 25 weight percent, from about 0.1 to about 15 weight percent, from about 1 to about 12 weight percent, from about 7 to about 10 weight percent, from about 1 to about 15 weight percent, from about 1 to about 10 weight percent, from about 0.2 to about 15 weight percent, from about 0.01 to about 30 weight percent, or from about 3 to about 12 weight percent, and more specifically, about 10 weight percent.

PHOTOCONDUCTOR LAYER EXAMPLES

A number of materials and compositions can be selected for the various photoconductive layers inclusive of known materials.

The thickness of the photoconductor separating substrate layer depends on many factors, including economical considerations, electrical characteristics, adequate flexibility, availability, and cost of the specific components for each layer, and the like, thus this layer may be of a substantial thickness, for example about 3,000 microns, such as from about 1,000 to about 2,000 microns, from about 500 to about 1,000 microns, or from about 300 to about 700 microns ("about" throughout includes all values in between the values recited), or of a minimum thickness. In embodiments, the thickness of this layer is from about 75 to about 300 microns, or from about 100 to about 150 microns.

The photoconductor substrate may be opaque or substantially transparent, and may comprise any suitable material including known or future developed materials. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, gold, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired, and economical considerations. For a drum, this layer may be of a substantial thickness of, for example, up to many centimeters or of a minimum thickness of less than a millimeter. Similarly, a flexible belt may be of a substantial thickness of, for example, about 250 microns, or of a minimum thickness of less than about 50 microns provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, supporting substrate layers selected for the photoconductors of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

Examples of electrically conductive layers or ground plane layers usually present on nonconductive substrates are gold, gold containing compounds, aluminum, titanium, titanium/zirconium, and other known suitable know components. The thickness of the metallic ground plane is, for example, from about 10 to about 100 nanometers, from about 20 to about 50 nanometers, and more specifically, about 35 nanometers, and the titanium or titanium/zirconium ground plane is, for example, from about 10 to about 30 nanometers, and more specifically, about 20 nanometers in thickness.

An optional hole blocking layer when present is usually in contact with the ground plane, and can be comprised of a number of known components as illustrated herein, such as metal oxides, phenolic resins, aminosilanes, mixtures thereof, and the like.

Aminosilane examples included in the hole blocking layer can be represented by

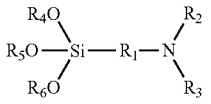

wherein $R_1$ is an alkylene group containing, for example, from 1 to about 25 carbon from 1 to about 18, from 1 to about 10, and from 2 to about 8 atoms; $R_2$ and $R_3$ are independently selected from the group consisting of at least one of hydrogen or alkyl containing, for example, from 1 to about 12 carbon atoms, and more specifically, from 1 to about 4 carbon atoms; aryl with, for example, from about 6 to about 42 carbon atoms, such as a phenyl group; and a poly(alkylene like ethylene amino) group; and $R_4$, $R_5$, and $R_6$ are independently selected from an alkyl group containing, for example, from 1 to about 12 carbon atoms, and more specifically, from 1 to about 4 carbon atoms.

Aminosilane specific examples include 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino)ethylamino]-3-proprionate, (N,N'-dimethyl 3-amino)propyl triethoxysilane, N,N-dimethylaminophenyl triethoxysilane, trimethoxysilyl propyldiethylene triamine, and the like, and mixtures thereof. Yet more specific aminosilane materials are 3-aminopropyl triethoxysilane (γ-APS), N-aminoethyl-3-aminopropyl trimethoxysilane, (N,N'-dimethyl-3-amino)propyl triethoxysilane, and mixtures thereof.

The aminosilane may be hydrolyzed to form a hydrolyzed silane solution before being added into the final undercoat coating solution or dispersion. During hydrolysis of the aminosilanes, the hydrolyzable groups, such as alkoxy groups, are replaced with hydroxyl groups. The pH of the hydrolyzed silane solution can be controlled to obtain excellent characteristics on curing, and to result in electrical stability. A solution pH of, for example, from about 4 to about 10 can be selected, and more specifically, a pH of from about 7 to about 8. Control of the pH of the hydrolyzed silane solution may be affected with any suitable material, such as generally organic or inorganic acids. Typical organic and inorganic acids include acetic acid, citric acid, formic acid, hydrogen iodide, phosphoric acid, hydrofluorosilicic acid, p-toluene sulfonic acid, and the like.

The hole blocking layer can, in embodiments, be prepared by a number of known methods, the process parameters being dependent, for example, on the photoconductor member desired. The hole blocking layer can be coated as a solution or a dispersion onto the supporting substrate or on to the ground plane layer by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 1 minute to about 10 hours, under stationary conditions, or in an air flow. The coating can be accomplished to provide a final coating thickness of, for example, from about 0.01 to about 30 microns, or from about 0.02 to about 5 microns, or from about 0.03 to about 0.5 micron after drying.

Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo) perylene, titanyl phthalocyanines, and the like, and more specifically, vanadyl phthalocyanines, Type V hydroxygallium phthalocyanines, high sensitivity titanyl phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 to about 10 microns, and more specifically, from about 0.25 to about 2 microns when, for example, the photogenerating compositions are present in an amount of from about 30 to about 75 percent by volume. The maximum thickness of this layer, in embodiments, is dependent primarily upon factors, such as photosensitivity, electrical properties, and mechanical considerations.

The photogenerating composition or pigment can be present in a resinous binder composition in various amounts inclusive of up to 100 percent by weight. Generally, however, from about 5 to about 95 percent by volume of the photogenerating pigment is dispersed in about 95 to about 5 percent by volume of the resinous binder, or from about 20 to about 30 percent by volume of the photogenerating pigment is dispersed in about 70 to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly (vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like, hydrogenated amorphous silicon and compounds of silicon and germanium, carbon, oxygen, nitrogen, and the like fabricated by vacuum evaporation or deposition. The photogenerating layer may also comprise inorganic pigments of crystalline selenium and its alloys; Groups II to VI compounds; and organic pigments such as quinacridones, polycyclic pigments, such as dibromo anthanthrone pigments, perylene and perinone diamines, polynuclear aromatic quinones, azo pigments including bis-, tris- and tetrakis-azos, and the like, dispersed in a film forming polymeric binder, and fabricated by solvent coating techniques.

In embodiments, examples of polymeric binder materials that can be selected as the matrix or binder for the photogenerating layer are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly (phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene, acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 10 microns, about 0.4 to about 1 micron, or from about 0.2 to about 2 microns can be applied to or deposited on a supporting substrate, or on other surfaces situated in between the substrate and the charge transport layer. A charge blocking layer or hole blocking layer may optionally be applied to the electrically conductive supporting substrate surface prior to the application of the photogenerating layer. When desired, an adhesive layer may be included between the charge blocking, hole blocking layer or interfacial layer, and the photogenerating layer. Usually, the photogenerating layer is applied onto the hole blocking layer or undercoat layer, and a charge transport layer or plurality of charge transport layers is formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary, and in embodiments is, for example, from about 0.05 to about 0.3 micron. The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As an optional adhesive layer or layers usually in contact with, or situated between the hole blocking layer and the photogenerating layer, there can be selected various known substances inclusive of copolyesters, polyamides, poly(vinyl butyral), poly(vinyl alcohol), polyurethane, and polyacrylonitrile. This layer is, for example, of a thickness of from about 0.001 to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure, further desirable electrical and optical properties.

A number of charge transport compounds can be included in the charge transport layer, which layer generally is of a thickness of from about 5 to about 75 microns, from about 10 to about 50 microns, from about 20 to about 35 microns, from about 10 to about 40 microns, and more specifically, of a thickness of from about 10 to about 40 microns. Examples of charge transport components are aryl amines of the following formulas/structures

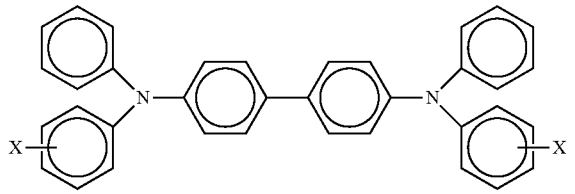

and

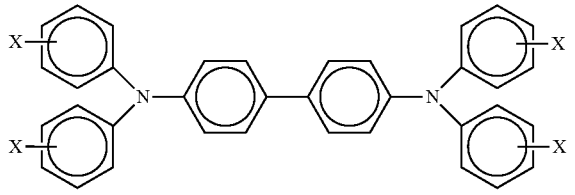

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

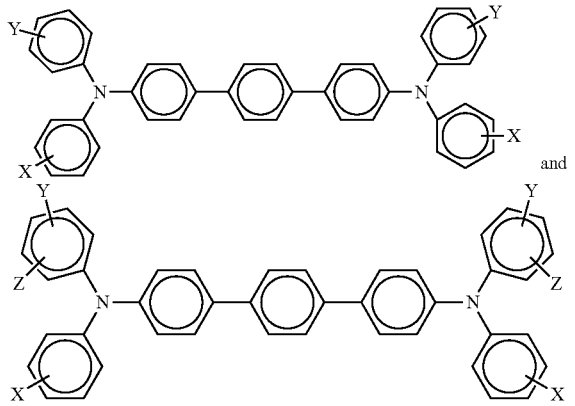

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1, 1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butyphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene) carbonate (also referred to as bisphenol-A-polycarbonate), poly(4,4'-cyclohexylidine diphenylene) carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer, may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules present, for example, in an amount of from 40 to about 90, and from about 50 to about 75 weight percent, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenly]-4,4'-diamine, N,N'-diphenyl-N,N'-bis(3-chlorophenyl)-[p-terphenyl]-4,4'-diamine; hydrazones such as N-phenyl-N-methyl-3-(9-ethyl)carbazyl hydrazone and 4-diethyl amino benzaldehyde-1,2-diphenyl hydrazone; and oxadiazoles such as 2,5-bis(4-N,N'-diethylaminopheny)-1,2,4-oxadiazole, stilbenes, and the like. However, in embodiments, to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency, and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine, or mixtures thereof. If desired, the charge transport material in the charge transport layer may comprise a polymeric charge transport material, or a combination of a small molecule charge transport material and a polymeric charge transport material.

Examples of components or materials optionally incorporated into the charge transport layers, or at least one charge transport layer to, for example, enable excellent lateral charge migration (LCM) resistance include hindered phenolic antioxidants, such as tetrakis methylene(3,5-di-tert-butyl-4-hydroxy hydrocinnamate)methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARKTM LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20 weight percent, from about 1 to about 10 weight percent, or from about 3 to about 8 weight percent.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is as illustrated herein, such as from about 20 to about 75 microns, but thicknesses outside this range may, in embodiments, also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported to selectively discharge a surface charge present on the surface of the photoconductor. Typical application techniques include spraying, dip coating, roll coating, wire wound rod coating, and the like. Drying of the deposited coating may be effected by any suitable conventional technique, such as oven drying, infrared radiation drying, air drying, and the like. A known optional overcoating may be applied over the charge transport layer to provide abrasion protection.

In embodiments, the present disclosure relates to a photoconductive imaging member comprised of a titanium/zirconium containing ground plane layer, a hole blocking layer, a photogenerating layer, a charge transport containing sulfonamide layer, and an overcoating charge transport layer; a photoconductive member with a photogenerating layer of a thickness of from about 0.1 to about 8 microns, and at least one transport layer, each of a thickness of from about 5 to about 100 microns; an imaging method and an imaging apparatus containing a charging component, a development component, a transfer component, and a fixing component, and wherein the apparatus contains a photoconductive imaging member comprised of a supporting substrate, a ground plane layer, a hole blocking layer, and thereover a photogenerating layer comprised of a photogenerating pigment, and a sulfonamide containing charge transport layer or layers, and thereover an overcoating charge transport layer, and where the transport layer is of a thickness of from about 40 to about 75 microns; a member wherein the photogenerating layer contains a photogenerating pigment present in an amount of from about 8 to about 95 weight percent; a photoconductor wherein the thickness of the photogenerating layer is from about 0.1 to about 4 microns; a member wherein the photogenerating layer contains a polymer binder; a photoconductor wherein the binder is present in an amount of from about 50 to about 90 percent by weight, and wherein the total of all layer components is about 100 percent; a member wherein the photogenerating component is a titanyl phthalocyanine or a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate, aluminized polyethylene naphthalate, titanized polyethylene terephthalate, titanized polyethylene naphthalate, titanized/zirconized polyethylene terephthalate, titanized/zirconized polyethylene naphthalate, goldized polyethylene terephthalate, or goldized polyethylene naphthalate; an imaging member wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating pigment is a metal free phthalocyanine; a photoconductive member wherein each of the charge transport layers comprises

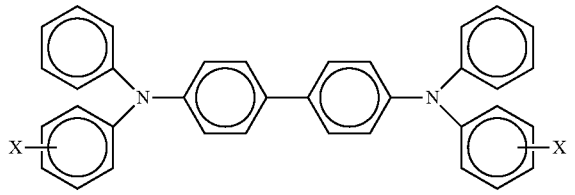

wherein X is selected from the group consisting of alkyl, alkoxy, aryl, and halogen wherein alkyl and alkoxy contains, for example, from about 1 to about 18 carbon atoms wherein alkyl contains from about 1 to about 5 carbon atoms wherein alkyl is methyl; an imaging member wherein each of, or at least one of the charge transport layers comprises

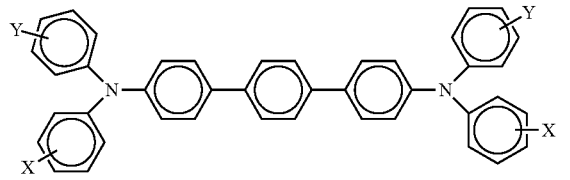

wherein X and Y are independently alkyl, alkoxy, aryl, a halogen, or mixtures thereof; an imaging member wherein alkyl and alkoxy for the charge transport component aryl amine contain from about 1 to about 12 carbon atoms; an imaging member wherein alkyl contains from about 1 to about 5 carbon atoms, and wherein the resinous binder is selected from the group consisting of polycarbonates and polystyrene; an imaging member wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees; a method of imaging which comprises generating an electrostatic latent image on an imaging member developing the latent image, and transferring the developed electrostatic image to a suitable substrate; a method of imaging wherein the imaging member is exposed to light of a wavelength of from about 370 to about 950 nanometers; a photoconductive member wherein the photogenerating layer is situated between the substrate and the charge transport; a member wherein the charge transport layer is situated between the substrate and the photogenerating layer; a member wherein the photogenerating layer is of a thickness of from about 0.1 to about 50 microns; a member wherein the photogenerating pigment is dispersed in from about 1 weight percent to about 80 weight percent of a polymer binder; a member wherein the binder is present in an amount of from about 50 to about 90 percent by weight, and wherein the total of the layer components is about 100 percent; an imaging member wherein the photogenerating component is Type V hydroxygallium phthalocyanine, Type V titanyl phthalocyanine or chlorogallium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butyl phenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine molecules, and wherein the hole transport resinous binder is selected from the group consisting of polycarbonates and polystyrene; an imaging member wherein the photogenerating layer contains a metal free phthalocyanine; a photoconductor wherein the photogenerating layer contains an alkoxygallium phthalocyanine; photoconductive imaging members comprised of a supporting substrate, a photogenerating layer, a hole transport layer, and in embodiments wherein a plurality of charge transport layers are selected, such as for example, from two to about ten, and more specifically two, may be selected; and a photoconductive imaging member comprised of an optional supporting substrate, a photogenerating layer, and a first, second, and third charge transport layer.

In embodiments, the charge transport component can be represented by the following formulas/structures

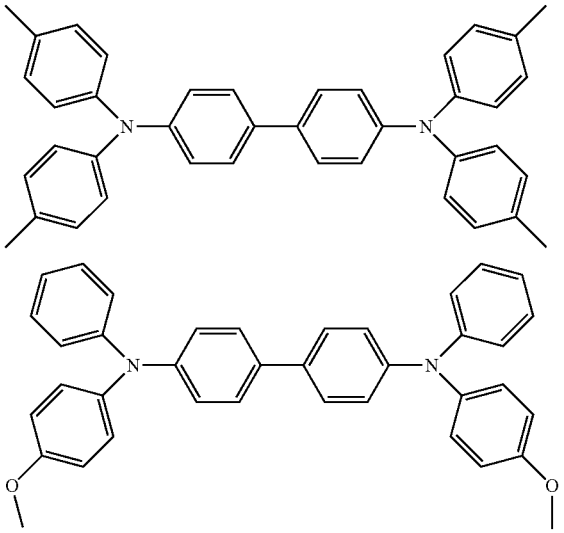

-continued

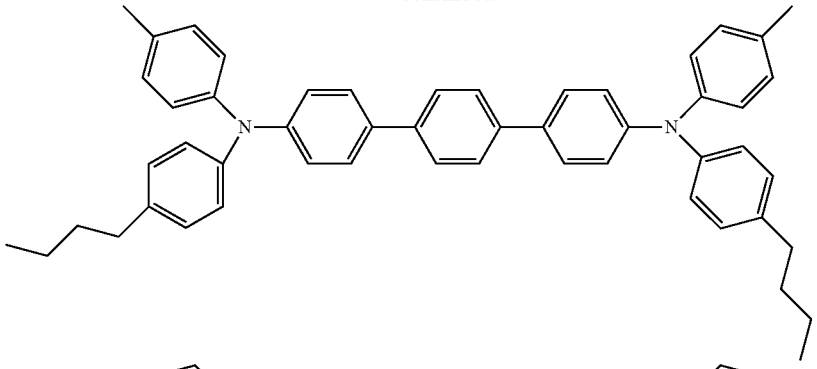

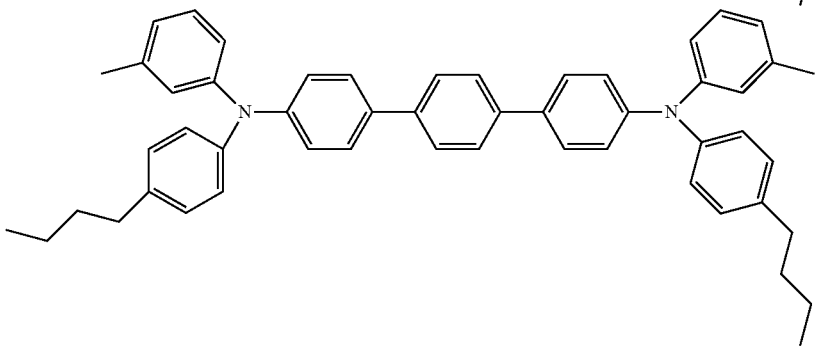

and

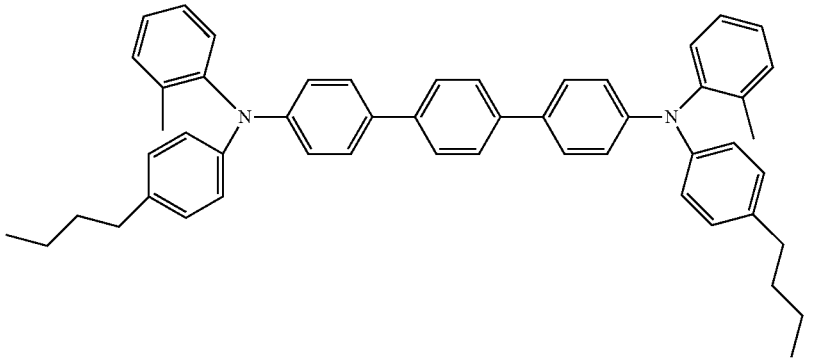

The following Examples are being submitted to illustrate embodiments of the present disclosure.

Comparative Example 1

A photoconductor was prepared by providing a 0.02 micron thick titanium/zirconium layer coated (coater device used) on a biaxially oriented polyethylene naphthalate substrate (KALEDEX™ 2000) having a thickness of 3.5 mils, and applying thereon, with a gravure applicator or an extrusion coater, a hole blocking layer solution containing 50 grams of 3-amino-propyltriethoxysilane, 41.2 grams of water, 15 grams of acetic acid, 684.8 grams of denatured alcohol, and 200 grams of heptane. This layer was then dried for about 5 minutes at 135° C. in the forced air dryer of the coater. The resulting blocking layer had a dry thickness of 500 Angstroms. An adhesive layer was then prepared by applying a wet coating over the blocking layer using a gravure applicator or an extrusion coater, and which adhesive layer contained 0.2 percent by weight based on the total weight of the solution of the copolyester adhesive (ARDEL™ D100 available from Toyota Hsutsu Inc.) in a 60:30:10 volume ratio mixture of tetrahydrofuran/monochlorobenzene/methylene chloride. The adhesive layer was then dried for about 5 minutes at 135° C. in the forced air dryer of the coater. The resulting adhesive layer had a dry thickness of 200 Angstroms.

A photogenerating layer dispersion was prepared by introducing 0.45 gram of the known polycarbonate IUPILON™ 200 (PCZ-200) or POLYCARBONATE Z™, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V), and 300 grams of ⅛ inch (3.2 millimeters) diameter stainless steel shot. The resulting mixture was then placed on a ball mill for 8 hours. Subsequently, 2.25 grams of PCZ-200 were dissolved in 46.1 grams of tetrahydrofuran, and added to the above hydroxygallium phthalocyanine dispersion. The obtained slurry was then placed on a shaker for 10 minutes. The resulting dispersion was, thereafter, applied to the above adhesive interface with a gravure applicator or an extrusion coater to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the known ground strip layer that was applied later. The photogenerating layer was dried at 120° C. for 1 minute in a forced air oven to form a dry photogenerating layer having a thickness of 0.4 micron.

The resulting imaging member web was then overcoated with one charge transport layer. The charge transport layer coating solution was prepared by introducing into an amber glass bottle in a weight ratio of 1:1 N,N'-diphenyl-N,N'-bis(3-methylphenyl)-1,1'-biphenyl-4,4'-diamine, and MAKROLON® 5705, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids. This solution was applied on the photogenerating layer to form the charge transport layer coating that upon drying (120° C. for 1 minute) had a thickness of 29 microns. During this coating process, the humidity was about 15 percent.

Example I

A photoconductor was prepared by repeating the process of Comparative Example 1 except that there was added to the charge transport layer 10 weight percent of N-butylbenzenesulfonamide, available as UNIPLEX® 214 from Unitex Chemical Corporation.

Example II

A photoconductor was prepared by repeating the process of Comparative Example 1 except that there was added to the charge transport layer 1 weight percent of N-butylbenzenesulfonamide, available as UNIPLEX® 214 from Unitex Chemical Corporation.

Example III

A photoconductor was prepared by repeating the process of Comparative Example 1 except that there was added to the charge transport layer 0.2 weight percent of N-butylbenzenesulfonamide, available as UNIPLEX® 214 from Unitex Chemical Corporation.

Example IV

A number of photoconductors are prepared by repeating the process of Comparative Example 1 except that there is added to the charge transport layer 10 weight percent of o,p-toluenesulfonamide, available as UNIPLEX® 171 from Unitex Chemical Corporation, or N-(2-hydroxylpropyl)benzenesulfonamide, available as UNIPLEX® 225 from Unitex Chemical Corporation.

Flatness Observation

The above prepared four photoconductors of Comparative Example 1, and Examples I, II and III were cut into 9 inch by 12 inch pieces, respectively. Without the sulfonamide in the charge transport layer, reference the Comparative Example 1 photoconductor, it immediately and automatically curled without human intervention into an approximately 2 inch diameter tube. With the 10 weight percent of the above N-butylbenzenesulfonamide in the charge transport layer, the Example I photoconductor was flat, 180 degrees in relationship to a supporting surface, in orientation without any curling for at least one year, thus eliminating the need for an anticurling backside coating (ACBC) layer.

When the Comparative Example 1 photoconductor belt curls, it tends to contract inside, thus changing the dimension of the photoconductor. This in turn impacts and decreases image transfer to paper, and the xerographic image quality is poor versus the substantially complete transfer of the xerographic image to paper, and excellent image quality for the photoconductor of Example I.

Electrical Property Testing

The above prepared four photoconductors of Comparative Example 1, and Examples I, II and III were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The above photoconductors were tested at surface potentials of 500 volts with the exposure light intensity incrementally increased by means of regulating a series of neutral density filters; and the exposure light source was a 780 nanometer light emitting diode. The xerographic simulation was completed in an environmentally controlled light tight chamber at ambient conditions (40 percent relative humidity and 22° C.).

Almost identical PIDCs were obtained for the above four photoconductors. Therefore, the incorporation of the above N-butylbenzenesulfonamide into the charge transport layer did not adversely affect the electrical properties of the photoconductors.

Charge Deficient Spots (CDS) Measurement

Various known methods have been developed to assess and/or accommodate the occurrence of charge deficient spots. For example, U.S. Pat. Nos. 5,703,487 and 6,008,653, the disclosures of each patent being totally incorporated herein by reference, disclose processes for ascertaining the microdefect levels of an electrophotographic imaging member or photoconductor. The method of U.S. Pat. No. 5,703,487, designated as field-induced dark decay (FIDD), involves measuring either the differential increase in charge over and above the capacitive value, or measuring reduction in voltage below the capacitive value of a known imaging member and of a virgin imaging member, and comparing differential increase in charge over and above the capacitive value or the reduction in voltage below the capacitive value of the known imaging member and of the virgin imaging member.

More specifically, U.S. Pat. Nos. 6,008,653 and 6,150,824, the disclosures of each patent being totally incorporated herein by reference, disclose a method for detecting surface potential charge patterns in an electrophotographic imaging member with a floating probe scanner. Floating Probe Micro Defect Scanner (FPS) is a contactless process for detecting surface potential charge patterns in an electrophotographic imaging member. The scanner includes a capacitive probe having an outer shield electrode, which maintains the probe adjacent to and spaced from the imaging surface to form a parallel plate capacitor with a gas between the probe and the imaging surface, a probe amplifier optically coupled to the probe, establishing relative movement between the probe and the imaging surface, and a floating fixture which maintains a substantially constant distance between the probe and the imaging surface. A constant voltage charge is applied to the imaging surface prior to relative movement of the probe and the imaging surface past each other, and the probe is synchronously biased to within about +/−300 volts of the average surface potential of the imaging surface to prevent breakdown, measuring variations in surface potential with the probe, compensating the surface potential variations for variations in distance between the probe and the imaging surface, and comparing the compensated voltage values to a baseline voltage value to detect charge patterns in the electrophotographic imaging member. This process may be conducted with a contactless scanning system comprising a high resolution capacitive probe, a low spatial resolution electrostatic voltmeter coupled to a bias voltage amplifier, and an imaging member having an imaging surface capacitively coupled to and spaced from the probe and the voltmeter. The probe comprises an inner electrode surrounded by and insulated from a coaxial outer Faraday shield electrode, the inner electrode connected to an opto-coupled amplifier, and the Faraday shield connected to the bias voltage amplifier. A threshold of 20 volts may be selected to count charge deficient spots.

The above prepared photoconductors of Comparative Example 1, and Examples I, II and III were measured for CDS counts using the above-described FPS technique, and the results follow in Table 1.

TABLE 1

| | CDS (counts/cm$^2$) |
|---|---|
| Comparative Example 1 | 4.8 |
| Example I, With 10 Weight Percent of the Sulfonamide in Charge Transport Layer | 0.5 |
| Example II, With 1 Weight Percent of the Sulfonamide in Charge Transport Layer | 1.0 |
| Example III, With 0.2 Weight Percent of the Sulfonamide in Charge Transport Layer | 1.3 |

Incorporation of the sulfonamide into the charge transport layer reduced and improved the CDS properties. With a small amount, such as 0.2 weight percent, of the sulfonamide (Example III), the CDS was reduced to about one fourth of that of the controlled photoconductor (Comparative Example 1).

When compared with the photoconductors comprising the plasticizers, such as dioctyl phthalate, diallyl phthalate, or diethyl phthalate, the disclosed sulfonamide photoconductor of Example I exhibited improved CDS properties by about 25 percent it is believed.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a substrate, a photogenerating layer, and a charge transport layer, and wherein said charge transport layer contains a N-alkylbenzenesulfonamide.

2. A photoconductor comprising a substrate, a photogenerating layer, and a charge transport layer, and wherein said charge transport layer contains N-butylbenzenesulfonamide.

3. A photoconductor in accordance with claim 2 wherein said N-butylbenzenesulfonamide is present in an amount of from about 0.01 to about 25 weight percent.

4. A photoconductor in accordance with claim 2 wherein said N-butylbenzenesulfonamide is present in an amount of from about 0.1 to about 15 weight percent.

5. A photoconductor in accordance with claim 2 wherein said N-butylbenzenesulfonamide is present in an amount of from about 1 to about 10 weight percent.

6. A photoconductor in accordance with claim 2 wherein said charge transport layer is comprised of a first charge transport layer in contact with said photogenerating layer, and a second charge transport layer in contact with said first charge transport layer, and wherein said N-butylbenzenesulfonamide is present in at least one of said first and said second charge transport layers.

7. A photoconductor in accordance with claim 2 wherein said N-butylbenzenesulfonamide is present in an amount of from about 0.01 to about 30 weight percent.

8. A photoconductor in accordance with claim 2 wherein said N-butylbenzenesulfonamide is present in an amount of from about 0.1 to about 20 weight percent.

9. A photoconductor in accordance with claim 2 wherein said N-butylbenzenesulfonamide is present in an amount of from about 1 to about 10 weight percent.

10. A photoconductor in accordance with claim 2 wherein said charge transport layer is comprised of at least one of

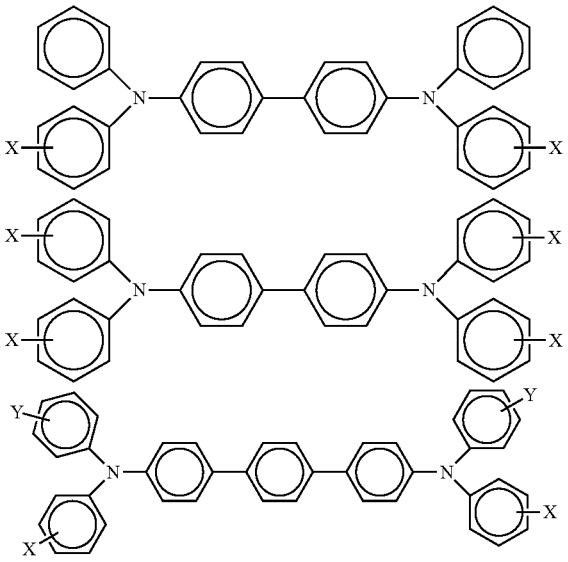

and

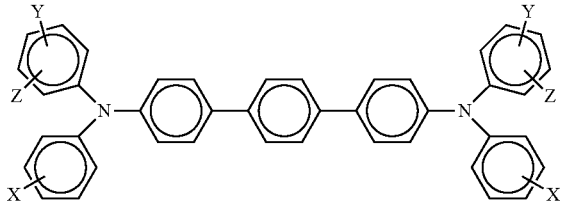

wherein X, Y, and Z are independently selected from the group consisting of alkyl, alkoxy, aryl, halogen, and mixtures thereof.

11. A photoconductor in accordance with claim 2 wherein said charge transport layer is comprised of a component selected from the group consisting of N,N'-bis(methylphenyl)-1,1-biphenyl-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terp-henyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine.

12. A photoconductor in accordance with claim 2 wherein said photogenerating layer is comprised of at least one photogenerating pigment.

13. A photoconductor in accordance with claim 12 wherein said photogenerating pigment is comprised of at least one of a titanyl phthalocyanine, a hydroxygallium phthalocyanine, a halogallium phthalocyanine, a bisperylene, and mixtures thereof.

14. A photoconductor in accordance with claim 2 wherein said charge transport layer is comprised of a charge transport component and a resin binder, and wherein said photogenerating layer is comprised of at least one photogenerating pigment and a resin binder; and wherein said photogenerating layer is situated between said substrate and said charge transport layer.

15. A photoconductor comprising a supporting substrate, a photogenerating layer, and a charge transport layer, and wherein said charge transport layer is in contact with said photogenerating layer, and said charge transport layer contains N-butylbenzenesulfonamide present in an amount of from about 0.1 to about 25 weight percent.

16. A photoconductor in accordance with claim 15 further including an undercoat layer and wherein said undercoat layer is comprised of an aminosilane, said charge transport layer is 1, 2 or 3 layers, and further including a ground plane layer in contact with said substrate, and an adhesive layer in contact with said undercoat layer.

17. A photoconductor in accordance with claim 16 wherein said aminosilane is at least one of 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino)ethylamino]-3-proprionate, (N,N'-dimethyl 3-amino)propyl triethoxysilane, N,N-dimethylaminophenyl triethoxysilane, trimethoxysilyl propyldiethylene triamine, and mixtures thereof.

18. A photoconductor in accordance with claim 16 wherein said aminosilane is represented by

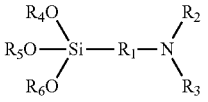

wherein $R_1$ is an alkylene; $R_2$ and $R_3$ are alkyl, hydrogen, or aryl, and each $R_4$, $R_5$ and $R_6$ is alkyl.

19. A photoconductor in accordance with claim 16 wherein said N-butylbenzenesulfonamide is present in an amount of from about 0.2 to about 12 weight percent.

20. A photoconductor in accordance with claim 16 wherein said charge transport layer is comprised of hole transport molecules, and a resin binder, and said N-butylbenzenesulfonamide, and said photogenerating layer is comprised of a photogenerating pigment, or a mixture of photogenerating pigments, and a resin binder.

21. A photoconductor in accordance with claim 2 further including in said charge transport layer an antioxidant comprised of at least one of a hindered phenolic and a hindered amine, and wherein said photoconductor further includes a ground plane layer situated between said substrate and said photogenerating layer.

22. A photoconductor in accordance with claim 2 further including a hole blocking layer and an adhesive layer, and wherein said hole blocking layer is situated between said substrate and said adhesive layer, and said photoconductor further includes a ground plane layer in contact with said substrate.

23. A photoconductor comprised in sequence of a photogenerating layer comprised of a photogenerating pigment, and a charge transport layer, and wherein said transport layer is comprised of a charge transport compound and a sulfonamide of N-butylbenzenesulfonamide present in an amount of from about 0.2 to about 10 weight percent.

24. A photoconductor in accordance with claim 16 wherein said aminosilane is 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy)silane, p-aminophenyl trimethoxysilane, N,N'-dimethyl-3-aminopropyl triethoxysilane, 3-aminopropylrnethyl diethoxysilane, 3-aminopropyl trimethoxysilane, N-methylaminopropyl triethoxysilane, methyl[2-(3-trimethoxysilylpropylamino)ethylamino]-3-proprionate, (N,N'-dimethyl 3-amino)propyl triethoxysilane, N,N-dimethylaminophenyl triethoxysilane, or trimethoxysilyl propyldiethylene triamine, said N-butylbenzenesulfonamide is present in an amount of from about 0.1 to about 12 weight percent; said charge transport layer is 1 or 2 layers; said photogenerating layer is comprised of at least one photogenerating pigment and said charge transport layer is comprised of hole transport molecules, said N-butylbenzenesulfonamide and a polymeric binder.

* * * * *